United States Patent [19]

Peterson

[11] 4,070,737

[45] Jan. 31, 1978

[54] ADJUSTABLE BED MECHANISM FOR A CASKET

[76] Inventor: Charles R. Peterson, 918 Jackson Ave., River Forest, Ill. 60305

[21] Appl. No.: 684,247

[22] Filed: May 7, 1976

[51] Int. Cl.[2] ..... A61G 17/00

[52] U.S. Cl. ..... 27/12

[58] Field of Search ..... 27/12, 1, 2; 5/62, 68, 5/328; 248/288

[56] References Cited

U.S. PATENT DOCUMENTS

| | | | |
|---|---|---|---|
| 2,839,814 | 6/1958 | Harter | 27/12 |
| 2,848,781 | 8/1958 | Slaughter, Jr. et al. | 27/12 |
| 2,888,732 | 6/1959 | Nelson | 27/12 |
| 3,041,704 | 7/1962 | Gruber | 27/12 |
| 3,653,104 | 4/1972 | Nelson | 27/12 |
| 3,692,267 | 9/1972 | Kronas et al. | 248/288 |

*Primary Examiner*—John D. Yasko

*Attorney, Agent, or Firm*—Kinzer, Plyer, Dorn & McEachran

[57] ABSTRACT

A mechanism for raising, lowering and tilting a casket bed. The mechanism includes and upstanding threaded rod mounted in a casket for rotation about its longitudinal axis. A bracket is attached to the threaded rod for vertical movement along the rod upon rotation thereof. The bracket has a leg with an opening which receives the rod. This leg is inclined to the rod at the same angle as the lead angle of the threads on the rod. The diameter of the opening in the leg is smaller than the crest diameter of the threads of the rod to form a driving engagement between the threads of the rod and the bracket leg. A casket bed frame is pivotally connected to a the bracket. A friction material is positioned between the bracket and the casket bed frame. The bracket friction material and casket bed frame are joined by a lockbolt under a preset compression which holds these members together in friction engaging contact sufficient to retain the casket bed in a selected pivotal position under its normal load while permitting pivotal movement of the casket bed upon the application of additional force. Stop means are provided to limit the maximum tilting of the casket bed.

11 Claims, 4 Drawing Figures fig.1.
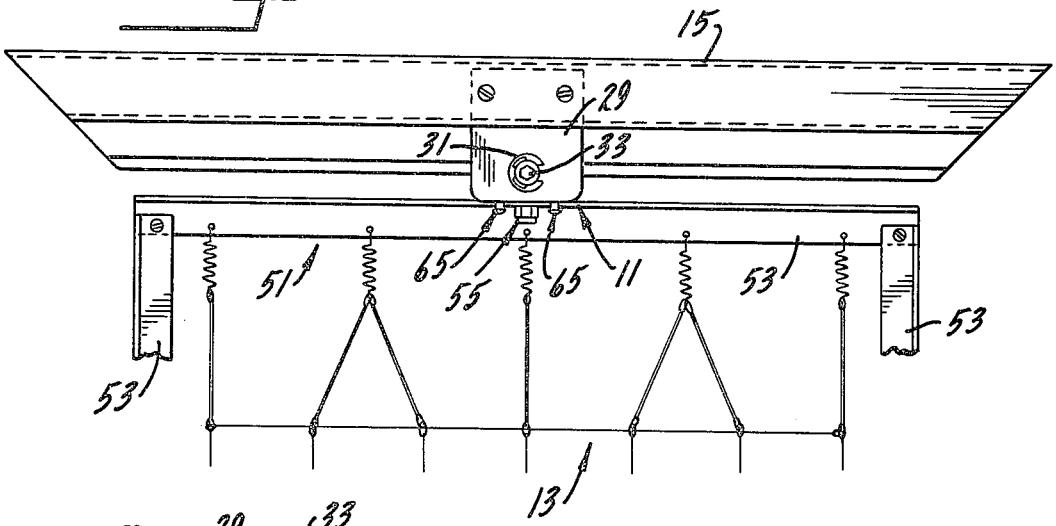
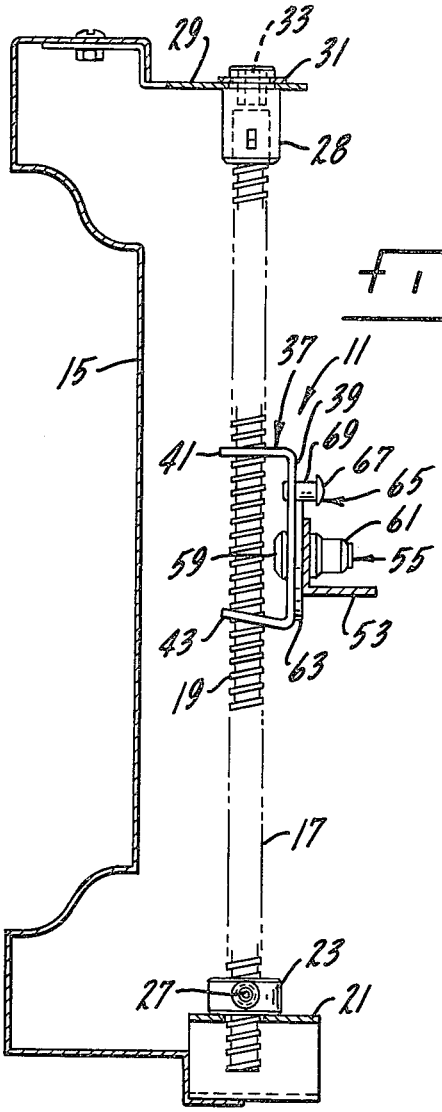
fig.2.
fig.3.
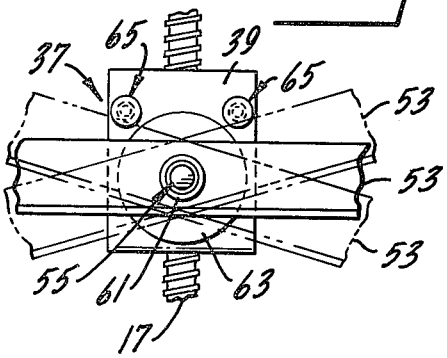
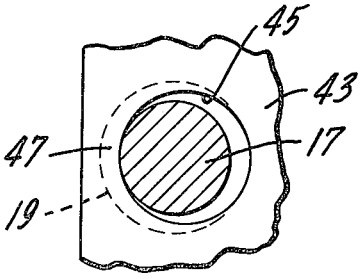
fig.4.

ADJUSTABLE BED MECHANISM FOR A CASKET

BACKGROUND OF THE INVENTION

Burial caskets are customarily equipped with beds which can be raised or lowered. It is also desirable that the head end of the bed be tiltable to either side for better display of the deceased. Because of the inherent flexibility of the casket bed frame, it is usually necessary only to provide a mechanism for tilting the head end of the casket bed. The foot end of the casket bed is usually provided with a mechanism for raising and lowering the bed but not tilting it.

Many complicated mechanisms have been designed and built to perform the functions of raising, lowering and tilting the casket bed. For example, Harms Pat. No. 1,831,108 shows a spring frame which is curved or arched downwardly and in which the sides of the frame slope from an intermediate point upwardly towards the ends to eliminate the necessity of tilting or canting the frame laterally or to one side. Harter Pat. No. 2,839,814 utilizes a detent mechanism 58 to hold the casket bed tilting mechanism in any one of a number of spaced recesses 60 until the thumbscrew 42 can be tightened to hold the casket bed in a selected position. Slaughter, Jr. et al U.S. Pat. No. 2,848,781 shows a tilting mechanism in which a thumbscrew 47 is used to tighten a bed frame angle 37 and a bracket plate 41 against a friction material 39 to hold the bed in a selected tilted position. Nelson Pat. No. 2,888,732 shows a parallelogram type of mechanism for tilting a casket bed. Gruber U.S. Pat. No. 3,041,704 shows a non-tiltable raising and lowering mechanism for a casket bed. Dower Pat. No. 3,065,516 shows a casket bed raising, lowering and tilting mechanism which utilizes two threaded rods for tilting the head of the casket bed. Nelson Pat. No. 3,653,104 shows a casket tilting mechanism using a pair of threaded rods for tilting the casket bed mechanism.

As the mechanisms for raising, lowering and tilting casket beds have been more complicated, they have also become more susceptible to malfunctions. This is particularly critical because many funeral directors who must adjust the casket bed, usually while it is occupied by the deceased, have limited mechanical aptitude and can easily become confused by complicated mechanical mechanisms. Further, increased manufacturing and material costs have made complicated mechanisms even less desirable. With this background, the advantages of the invention hereinafter described will be more fully appreciated.

SUMMARY OF THE INVENTION

This invention is concerned with a mechanism for raising, lowering and tilting a casket bed.

An object of this invention is a tilting mechanism for a casket bed which permits the casket bed to be tilted within its operating range without the use of any tools.

Another object is a tilting mechanism for a casket bed which will automatically retain the casket bed in a selected position of orientation.

Another object is a tilting mechanism for a casket bed which permits the bed to be tilted and will hold the bed in a selected position without requiring the manipulation of any locking mechanism.

Another object is a tilting mechanism for a casket bed which permits a person of limited mechanical ability to easily position the casket bed in a tilted position.

Another object is a tilting mechanism for a casket bed which provides the casket bed with a built-in predetermined resistance to tilting movement.

Another object is a simplified casket bed support bracket for use in a mechanism for raising and lowering a casket bed.

Other objects may be found in the following specification, claims and drawings.

BRIEF DESCRIPTION OF THE DRAWINGS

The invention is illustrated more or less diagrammatically in the drawings wherein:

FIG. 1 is a partial top plan view of the mechanism of this invention;

FIG. 2 is an enlarged side elevational view of the mechanism of this invention with some parts omitted for clarity of illustration;

FIG. 3 is a partial front elevational view of the mechanism of FIG. 2 showing the casket bed frame in various positions of adjustment; and FIG. 4 is an enlarged cross sectional view of the casket bed support bracket and screw post.

DESCRIPTION OF THE PREFERRED EMBODIMENT

The mechanism 11 of this invention for raising, lowering and tilting a casket bed 13 is shown mounted on an end wall 15 of a casket at the head thereof. Because the mechanism 11 of this invention may be installed on caskets of different constructions and because the casket forms no part of this invention, only enough of the casket is shown as is necessary to facilitate the explanation of the mechanism of this invention.

Mechanism 11 includes an elongated threaded rod 17 having threads 19 of a modified Acme type. The threaded rod 17 is mounted in an upstanding position in the casket and is supported on a U-shaped base bracket 21 through means of a collar 23 secured to the threaded rod by a locking screw 27. The upper end of the threaded rod is staked to a drive socket 28 which fits in an opening (not shown) in a top bracket 29. The drive socket is secured to the top bracket by means of an E-clip 31 which fits into a circumferential groove (not shown) formed in the drive socket. A hexagonal shaped recess 33 is formed in the top of the drive socket and is adapted to receive a conventional Allen wrench for rotating the threaded rod 17. The top bracket 29 is fastened to the top surface of the end wall 15 of the casket by threaded fasteners, or by any other conventional means.

A somewhat C-shaped casket bed supporting bracket 37 is mounted to move up and down along the threaded rod 17 upon rotation of the rod. The bracket includes a central portion 39 of generally rectangular shape and legs 41 and 43 which are formed integrally with and extend from the ends of the central portion. Leg 41 extends generally perpendicular to the central portion while leg 43 is inclined from the perpendicular relative to the central portion. As is shown most clearly in FIG. 4, a circular opening 45 is formed in the inclined leg 43 to receive the threaded rod 17. This opening has a diameter less than the crest diameter of the threads 19 of the threaded rod in order to provide a driving engagement 47 between the inclined leg and the threads of the threaded rod. By way of an example, when using a one-half inch modified Acme threaded rod, the opening 45 is formed with a 7/16" diameter. The bracket 37 is formed from 12 ga. steel. Thus, the thickness of the leg 43 is approximately the same as the distance between threads 19 at the root of the threaded rod. An opening is also formed in the leg 41 to receive the threaded rod 17. This opening is formed slightly larger in diameter than the crest diameter of the threads of the threaded rod.

A casket bed frame 51 formed of steel angles 53 is attached to the casket bed supporting bracket 37 by means of a pivotal mounting 55. In the preferred embodiment of the invention, the pivotal mounting is a lockbolt of the type sold by Townsend/TRS., a division of Townsend Company. The lockbolt includes a headed pivot pin 59 having a locking collar 61 which is swaged onto the pin. A fiber disc 63 fits over the pivot pin 59 and is compressed between the angle 53 and the central portion 39 of the bracket 37. The pivotal mounting joins the bracket 37, angle 53 and fiber disc 63 together under a predetermined amount of compressive force to provide a frictional resistance against pivoting sufficient to hold the casket bed frame 51 in any selected tilted position while permitting the casket bed frame to be tilted upon the application of twisting force to the casket bed frame 51. The size and type of washer may be varied in accordance with operating requirements. In the preferred form of the invention, a gray fiber washer of $1\frac{1}{4}$ inches O.D. × 25/64" I.D. × 5/64" thick was used. To limit the rotation of the casket bed within predetermined limits, stops 65 are provided which extend from the face of the central portion 39 of the casket bed support bracket 37 to engage the casket bed frame angle 53. Each of these stops includes a hollow rivet 67 which extends through a sleeve 69.

The use, operation and function of the invention are as follows:

The casket bed frame 51 may be raised and lowered in the casket by rotation of the threaded rod 17. Rotation of the rod is accomplished by the use of an Allen or other wrench of hexagonal cross-section which is inserted into the recess 33 in the socket head 28. Rotation of the threaded rod 17 moves the casket bed frame support bracket 37 up and down along the threaded rod. A raising and lowering mechanism for the casket bed frame is usually also provided at the foot of the casket. Such a mechanism may include a threaded rod 17 and a casket bed support bracket 37 of the type shown herein, but usually will not have a tilting means for the casket bed frame. For clarity of illustration, the mechanism at the foot of the casket bed is not shown or described.

The driving engagement between the bracket 37 and the threads 19 of the threaded rod 17 is shown most clearly in FIG. 4. The leg 43 of the bracket 37 is inclined to the threaded rod at the same angle as the lead angle of the threads 19 of the threaded rod. The thickness of the leg is approximately the same as the distance between the threads 19 at the root diameter of the threaded rod. The diameter of the circular opening 45 formed in the inclined leg 43 of the bracket 37 is smaller than the crest diameter of the threads 19 of the threaded rod 17. This difference in diameters provides a contact area 47 between the leg 43 and the threads 19 of the threaded rod 17 so that upon rotation of the rod, the bracket 37 will be moved up and down. This construction eliminates the need for a thrust collar between the bracket 37 and the threaded rod 17 and thus provides a simpler and less expensive casket bed frame raising and lowering mechanism than those in general use.

The pivotal connection 55 between the casket bed supporting bracket 37 and the casket bed frame 51 exerts a compressive force of predetermined magnitude on these members and on the fiber washer 63 which is located between these members. The magnitude of the compressive force is preset to obtain a frictional resistance between these members which will retain the casket bed frame in any selected period of adjustment, yet will permit rotation of the casket bed frame to a new position simply by manually engaging the casket bed frame and turning it about the pivotal mounting 55. As previously mentioned, it is not necessary to provide a pivotal mounting between the casket bed frame and the support bracket at the foot end of the frame. Normally, there is sufficient flexibility in the frame. Normally, there is sufficient flexibility in the casket bed frame to allow the head end of the bed frame to twist while the foot end of the frame remains in the horizontal position.

The casket bed frame can be tilted within the limits defined by the stop members 65 and the casket bed frame will remain in any tilted position selected even under the weight of a corpse on the bed. The bed frame can be tilted from one position to the other without requiring the use of any tools or the unlocking or locking of any mechanism. Therefore, manipulation of the casket bed frame does not require a high level of mechanical ability.

Whereas, the preferred form of the invention has been shown and described herein, it should be understood that many modifications, changes and alterations may be made to the embodiment of the invention without departing from the teaching of this invention. Therefore, the scope of this invention should be interpreted in light of the claims appended hereto.

I claim:

1. A tilting mechanism for a casket bed, said mechanism including:
   - a vertically extending threaded rod,
   - a bracket mounted on the threaded rod and movable vertically along the rod upon rotation thereof,
   - a pivotal connector joining the bracket and a casket bed frame,
   - the pivotal connector providing a predetermined, nonadjustable resistance to tilting movement of the casket bed frame relative to the bracket which resistance is sufficient to retain the casket bed frame in any selected tilted position under the normal load carried by the casket bed frame while permitting pivotal movement of the casket bed frame to another tilted position upon the application of additional force to the casket bed.

2. The tilting mechanism of claim 1 in which said pivotal connector includes a pin, a fastener permanently attached to the pin and a friction material positioned adjacent the pin and contacting the bracket and the casket bed frame, and
   - the pin and fastener exert a preselected amount of compressive force against the bracket, friction material and casket bed frame to provide the predetermined, non-adjustable resistance to tilting movement of the pivotal connector.

3. The tilting mechanism of claim 2 in which said pin and fastener are parts of a lockbolt.

4. The tilting mechanism of claim 1 in which stop means are provided to limit pivotal movement of said casket bed frame.

5. The tilting mechanism of claim 4 in which said stop means are mounted on said bracket.

6. The tilting mechanism of claim 1 in which said friction material is a fiber washer.

7. The tilting mechanism of claim 1 in which said bracket has upper and lower legs, each leg includes an opening which receives the threaded rod, one of said legs is inclined to the longitudinal axis of the threaded rod at the same angle as the lead angle of the threads of the threaded rod, the opening of said inclined leg having a diameter smaller than the crest diameter of said threaded rod to provide a driving engagement between the threads of the threaded rod and the inclined bracket leg.

8. A mechanism for raising and lowering a casket bed, said mechanism including:

a threaded rod, means mounting said threaded rod in an upstanding position in the casket for rotation about its longitudinal axis, a bracket mounted on said threaded rod for movement along said rod upon rotation of the rod, at least one leg formed as part of said bracket, an opening formed in the leg to receive said threaded rod, said leg being inclined to the longitudinal axis of said threaded rod at the same angle as the lead angle of threads of the threaded rod, the opening in said inclined leg which receives said threaded rod having a diameter less than the crest diameter of said threaded rod to provide a driving engagement between the threads of the threaded rod and said inclined leg.

9. The mechanism of claim 8 in which the diameter of said opening in said inclined leg is equal to at least the root diameter of the threads of the threaded rod.

10. The mechanism of claim 8 in which the thickness of said inclined leg is approximately equal to the root distance between the threads of the threaded rod.

11. A tilting mechanism for a casket bed, said mechanism including:

a bracket adapted to be mounted on a vertically extending support, a pivotal connector joining the bracket and a casket bed frame, the pivotal connector including a pin, a fastener permanently attached to the pin and a friction material positioned adjacent the pin and contacting the bracket and casket bed frame, the pin and fastener exerting a preselected amount of compressive force against the bracket, friction material and casket bed frame, the preselected amount of compressive force providing a friction resistance between the bracket, friction material and casket bed frame at the pivotal connector sufficient to retain the casket bed frame in any selected tilted position under the normal load carried by the casket bed frame while permitting pivotal movement of the casket bed frame to another tilted position upon application of additional force to the casket bed.

* * * * *